US005125148A

United States Patent [19]

Krasnov

[11] Patent Number: 5,125,148

[45] Date of Patent: Jun. 30, 1992

[54] DRILL STRING TORQUE COUPLING AND METHOD FOR MAKING UP AND BREAKING OUT DRILL STRING CONNECTIONS

[76] Inventor: Igor Krasnov, 8002 Oakwood Forest Dr., Houston, Tex. 77040

[21] Appl. No.: 592,639

[22] Filed: Oct. 3, 1990

[51] Int. Cl.[5] ..... B23P 19/00

[52] U.S. Cl. ..... 29/426.6; 29/426.1; 29/426.5; 29/428; 175/85; 285/140; 285/333; 285/334.2

[58] Field of Search ..... 29/426.1, 426.5, 428, 29/426.6; 175/85; 166/77.5; 285/140, 333, 334.2, 341

[56] References Cited

U.S. PATENT DOCUMENTS

| | | | |
|---|---|---|---|
| 2,320,107 | 5/1943 | Speckert | 285/333 |
| 3,608,933 | 9/1971 | Lee | 403/320 |
| 3,866,954 | 2/1975 | Slator et al. | 285/333 |
| 4,534,585 | 8/1985 | Saliger | 285/333 |
| 4,658,915 | 4/1987 | Goris et al. | 175/57 |
| 4,830,121 | 5/1989 | Krasnov et al. | 175/57 |
| 4,875,529 | 10/1989 | Wetch et al. | 173/163 |

FOREIGN PATENT DOCUMENTS

| | | | |
|---|---|---|---|
| 2142402 | 1/1985 | United Kingdom | 285/140 |

*Primary Examiner*—Timothy V. Eley
*Assistant Examiner*—David P. Bryant
*Attorney, Agent, or Firm*—James E. Bradley

[57] ABSTRACT

A torque coupling for connecting between upper and lower tubular members of a drill rig allows make up and break out at lower torques than normally required. The coupling has a body which has an upper end that connects to the upper tubular member and lower end which connects to the lower tubular member. The lower tubular member has an upward facing torque shoulder. A torque shoulder sleeve mounts slideably to the body. The torque shoulder sleeve has a downward facing shoulder that engages the torque shoulder of the lower tubular member. The body and the torque shoulder sleeve have opposed load shoulders, at least one of which is conical. A wedge member locates between these load shoulders. When the wedge member slides outward, it decreases the distance between the load shoulders and reduces the pressure of the lower end of the torque shoulder sleeve against the upper end of the lower tubular member.

20 Claims, 4 Drawing Sheets

DRILL STRING TORQUE COUPLING AND METHOD FOR MAKING UP AND BREAKING OUT DRILL STRING CONNECTIONS

BACKGROUND OF THE INVENTION

1. Field of the Invention

This invention relates in general to oil and gas well drilling equipment, and in particular to a coupling device that connects into the upper end of the drill string to enable it to be broken out and made up with less torque than normally required.

2. Description of the Prior Art

In recent years, top and side drive oil and gas well drilling rigs have been commercially available. In these types of drilling rigs, drive equipment for rotating the drill pipe will be supported by the derrick. The drive assembly may be a top drive type as shown in U.S. Pat. No. 4,421,179. Or the drive assembly may be of a side drive type such as shown in U.S. Pat. No. 4,875,529. In both cases, a drive mechanism in the derrick will impart torque to the drill string.

Top and side drive drilling systems enable an operator to drill with a triple stand of pipe, rather than a single stand as with a kelly bushing type of drill rig. Particularly in the case of highly deviated wells, it enables a driller to ream as he is pulling out of and running into the hole. During reaming, the driller will rotate the pipe.

While reaming out of the hole, the top connection of each triple stand will be broken out high in the derrick. Also, if reaming while, going into the well, the top connection with the rotary drive spindle must be made up while high in the derrick. These operations require power make up and break out equipment in the derrick. If the make up and break out equipment does not have a back up, tongs must be employed on the rig floor for back up.

In U.S. Pat. No. 4,658,915, a coupling is shown for connection between the drive spindle and the top of a triple stand. This coupling will break out at a lower torque than making up. This avoids a need for a back up tong high in the derrick. Rather, the back up tong will be located at the rig floor, and the drive spindle will be rotated in reverse to break out the top connection. The break out torque, while lower, is still substantial.

SUMMARY OF THE INVENTION

In this invention, a torque coupling is employed between upper and lower tubular members in the drill string. The coupling makes up and breaks out with very little, if any, torque required. The coupling has a body which connects on its upper end to an upper tubular member of the drill string. The lower end is a pin for connection into the box of a lower tubular member. A torque shoulder sleeve will slide vertically on the exterior of the body. The torque shoulder sleeve has a torque shoulder which bears against the upward facing torque shoulder on the box of the lower tubular member.

The upper end of the torque shoulder sleeve has an upward facing load shoulder. The body has a downward facing load shoulder spaced above the upward facing load shoulder. At least one of these load shoulders is conical, so that the vertical distance between them increases from their inner diameters outward.

A wedge member locates between these load shoulders. The wedge member, when located in its inner position, tightly wedges the torque shoulder sleeve downward against the box torque shoulder. Moving the wedge member inward will apply a large preload force to the torque shoulders, providing a desired amount of make up torque.

Moving the wedge member outward will allow the distance to decrease between the upper end of the torque shoulder sleeve and the load shoulder of the body. This slight decrease in distance removes the preload at the torque shoulders to enable the connection to be easily broken out.

The wedge member is biased to the outer position. A retaining sleeve will hold the wedge member in the inner position until the retaining sleeve is moved vertically. When moved vertically to the released position, the wedge member springs outward to remove the preload force.

DETAILED DESCRIPTION OF THE INVENTION

Figure 1:
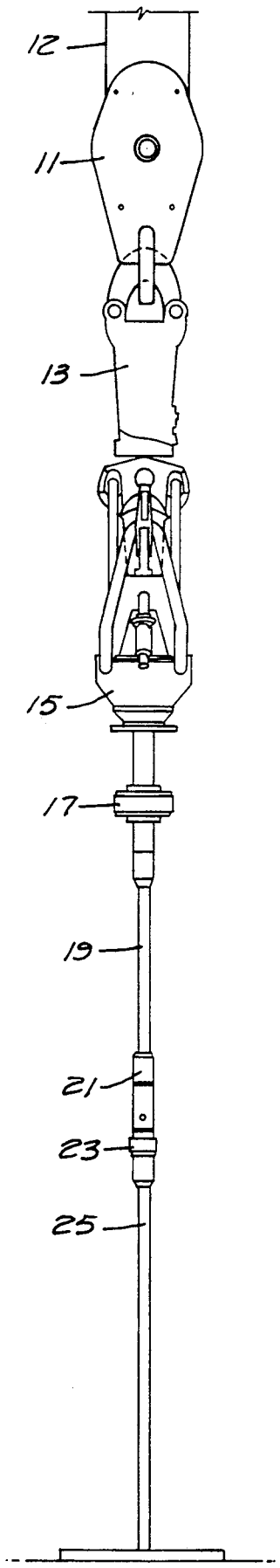
FIG. 1 is a side, partially schematic view, of a portion of a drill rig having a torque coupling constructed according to this invention, and shown connected into a drill string.

Referring to FIG. 1, the drilling rig will have blocks 11 suspended on cables 12. A hook 13 locates below blocks 11. The hook 13 will support a swivel 15 which allows the drill string to rotate relative to the blocks 11.

In the drill rig shown in FIG. 1, a power rotary drive 17 is shown suspended below the power swivel 15. The rotary drive 17 schematically represents some type of rotary drive for rotating the drill string relative to the swivel 15. This could be a side drive mechanism such as shown in U.S. Pat. No. 4,875,529 or a top drive mechanism such as shown in U.S. Pat. No. 4,421,179. If another type of rotary power is used for drilling, the rotary drive 17 could be a kelly spinner, which is capable of rotating a stand of drill pipe, but has little torque. The mechanism used to rotate the drill string could be of various types. For the purposes of this invention, rotary drive 17 need not be capable of making up or breaking out a conventional drill pipe joint to the desired make and break out torque. Rotary drive 17 need only be capable of rotating a tubular member at low torque.

A pup joint 19 extends below the rotary drive 17. A kelly cock 21 connects to the lower end pup joint 19. Kelly cock 21 is a valve for closing the inner passage of the drill string in case the fluid in the drill string starts blowing upward due to formation pressure being higher than the drilling fluid hydrostatic pressure. The kelly cock 21 can be manually operated or hydraulically or pneumatically powered.

A torque coupling 23 constructed in accordance with this invention locates below kelly cock 21. Torque coupling 23 connects to the upper end of the uppermost section of drill pipe 25. A slip assembly 27 is located at the rig floor to support the weight of the drill pipe 25 in the hole.

Figure 2:
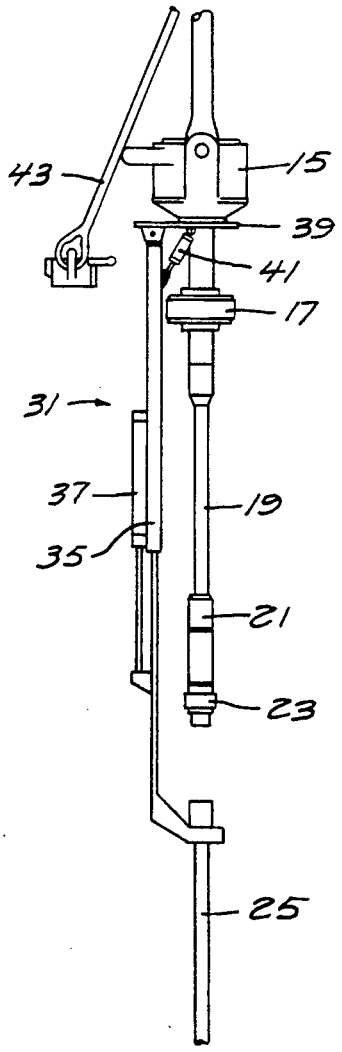
FIG. 2 is a partial view of a pipe handling mechanism for connecting the upper end of the drill string to the torque coupling used in FIG. 1.

Referring to FIG. 2, the drill rig will also have a pipe handler 31. Pipe handler 31 will be employed to stab the upper end of a triple stand of drill pipe 25 into the torque coupling 23. Pipe handler 31 may be of various types. In the embodiment shown, pipe handler 31 has a collar 33 which engages the upper end of the stand of drill pipe 25. A telescoping arm 35 supports collar 33. A hydraulic cylinder 37 will lift the collar 33 to cause the upper end of the drill pipe 25 to engage the lower end of the torque coupling 23.

A flange 39 mounted to swivel 15 supports pipe handler 31. A tilting cylinder 41 will enable the pipe handler 31 to be tilted out of alignment with torque coupling 23 while not used. A conventional elevator 43 also mounts to the hook 13 for tripping out of and into the hole when reaming is not utilized.

Figure 3:
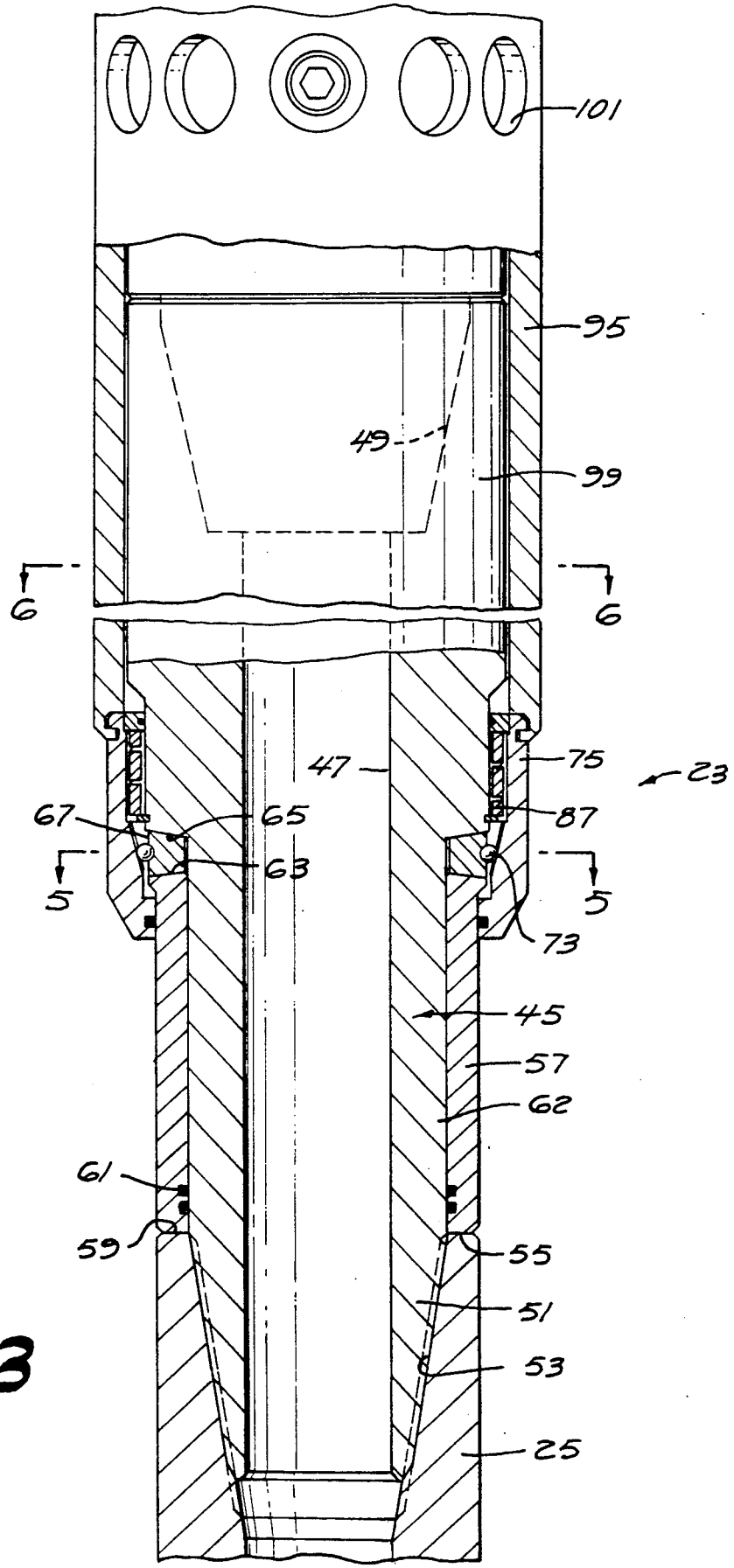
FIG. 3 is an enlarged vertical sectional view of the torque coupling of FIG. 1.

Referring to FIG. 3, torque coupling 23 includes a tubular body 45. Body 45 has an axial passage 47 extending through it. Threads 49 on the upper end serve as means for connecting the body 45 to an upper tubular member, which is the kelly cock 21 (FIG. 1) in the preferred embodiment. Body 45 has a threaded pin 51 on its lower end. Pin 51 has conventional drill pipe threads for engaging box threads 53 on the upper end of the drill pipe 25. The box threads 53 will conventionally have a torque shoulder 55 which is an external rim located on the upper end.

A torque shoulder sleeve 57 mounts to body 45. Torque shoulder sleeve 57 is capable of slight vertical sliding movement relative to body 45. A key or spline (not shown) prevents any rotation between torque shoulder sleeve 57 and body 45. Torque shoulder sleeve 57 has a downward facing torque shoulder 59 that will engage the box torque shoulder 55. It is necessary for the shoulders 59 and 55 to make up to a desired compressive load in order for the connections between the pin 51 and threads 53 to be fully made up. O-ring 61, located on the interior lower end of the torque shoulder sleeve 57, seals the torque shoulder sleeve 57 to the lower portion 62 of the body 45.

The torque shoulder sleeve 57 has a load shoulder 63 on its upper end. Load shoulder 63 is frusto-conical. It inclines downward and outward at a slight inclination relative to a plane perpendicular to the axis of body passage 47. The body 45 has a downward facing load shoulder 65 spaced a short distance above the load shoulder 63. The body load shoulder 65 is also frusto-conical. However, it inclines upward and outward at a slight angle relative to a plane perpendicular to the axis of passage 47. Preferably, the magnitudes of the angles of inclination of the load shoulders 63, 65 are the same. The radial dimensions from the inner diameters to the outer diameters of the load shoulders 63, 65 are the same. This results in an annular space between the shoulders 63, 65 that has an increasing vertical dimension from the inner diameters of the load shoulders 63, 65 outward. The vertical distance between the load shoulders 63, 65 at the inner diameters will be less than the vertical distance between the load shoulders 63, 65 at their outer diameters.

Figure 4:
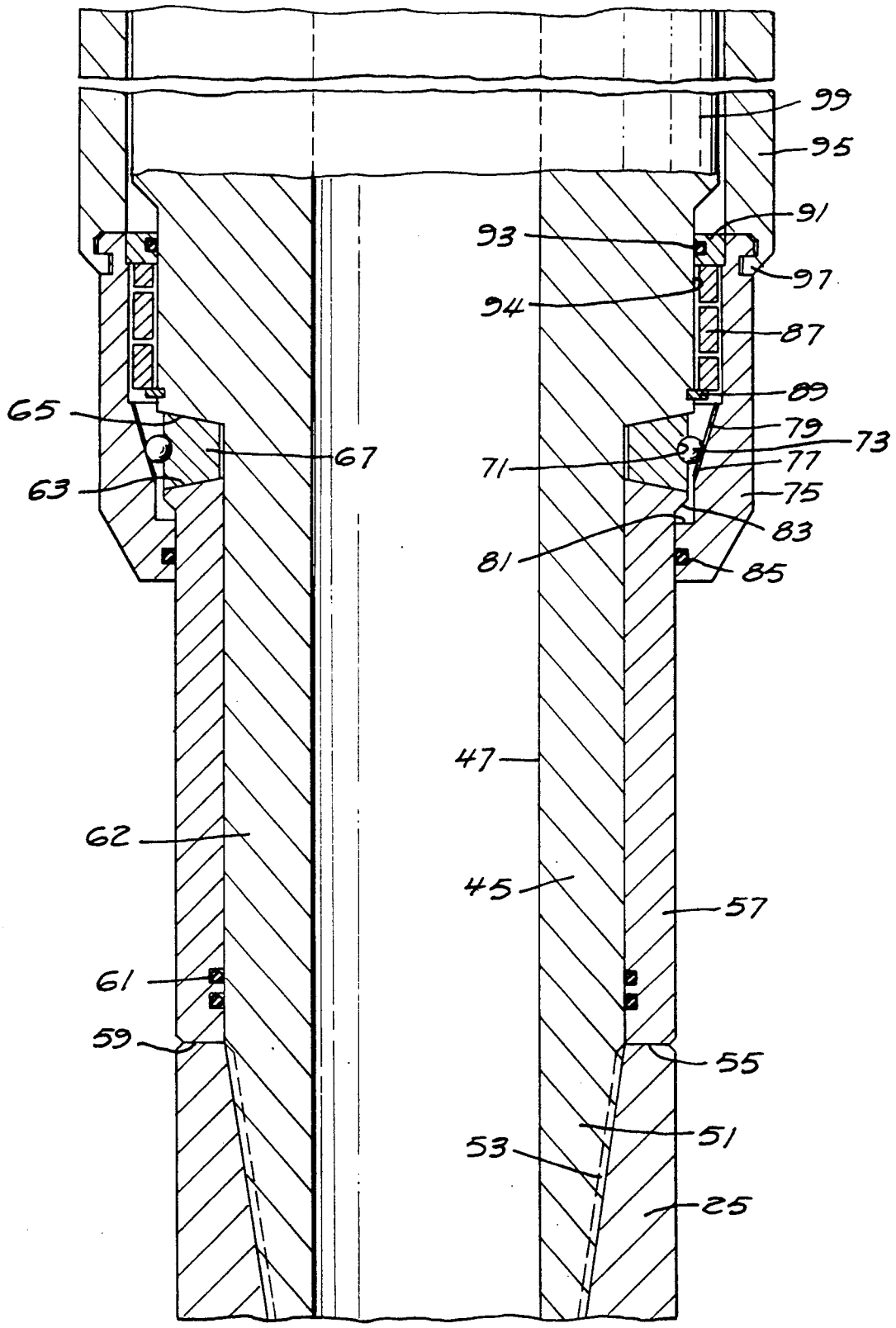
FIG. 4 is a further enlarged sectional view of a portion of the torque coupling of FIG. 3.
Figure 5:
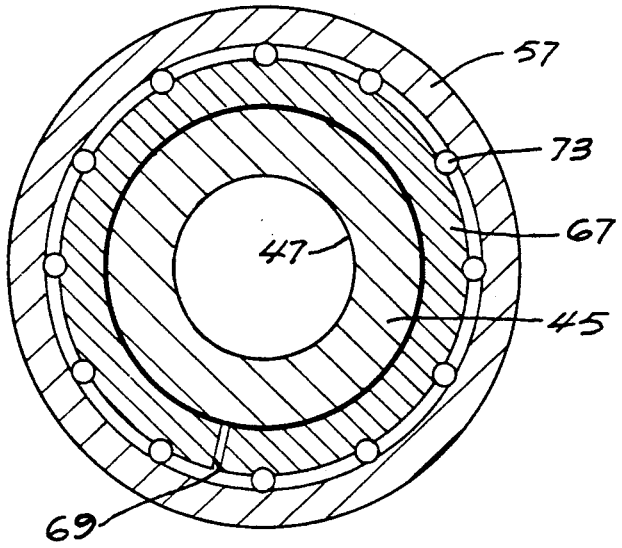
FIG. 5 is a transverse sectional view of the torque coupling of FIG. 3, taken along the line V—V of FIG. 3.

Referring to FIG. 4, a wedge ring 67 locates in the annular space between the load shoulders 63, 65. Wedge ring 67 is a metal resilient member and has a split 69, shown in FIG. 5. Wedge ring 67 has an upper side or surface that is frusto-conical and which inclines at the same angle as the body load shoulder 65. The lower side of wedge ring 67 is also frusto-conical and inclines at the same inclination as the sleeve load shoulder 63.

The wedge ring 67 will move from an inner position, which is shown in FIGS. 3 and 4, to an expanded outer position (not shown). The split 69 and the resiliency of the wedge ring 67 serves as a bias means to urge the wedge ring 67 from the contracted position to the outer expanded position. Unless restrained, the wedge ring 67 would spring outward to the expanded position, in which its outer diameter is radially beyond the outer diameters of the load shoulders 63, 65.

A retaining means is employed to selectively prevent the wedge ring 67 from springing out to the expanded position. This includes several concave recesses 71 spaced circumferentially around the outer diameter of the wedge ring 67. Each recess 71 will hold a steel ball 73. A retaining sleeve 75 locates on the exterior of the wedge ring 67. The retaining sleeve 75 has an inclined surface in its interior. Inclined surface 77 is conical and extends from a smaller diameter on its lower extent to a larger diameter on its upper extent. The inclined surface 77 locates radially outward from wedge ring 67. Vertical grooves 79 are formed in the incline surfaced 77 around the circumference of the inclined surface 77. Each groove 79 is opposite one of the recesses 71. Each ball 73 locates in one of the grooves 79. Each ball 73 thus has one side located in a recess 71 and another side in a groove 79.

The retaining sleeve 75 will move vertically relative to body 45 between an upper position, which is shown in FIGS. 3 and 4, and a lower position, which is not shown. In the upper or locked position, the balls 73 locate about on the vertical center of the grooves 79. The retaining sleeve 75 and the balls 73 prevent the wedge ring 67 from moving outward when in this locked position. When the retaining sleeve 75 moves downward to the unlocked position, the balls 73 will still be in the grooves 79, but near the upper ends of the grooves 79. The inclination of the grooves 79 allows the balls 73 and wedge ring 67 to move radially outward when moving to the unlocked position.

The retaining sleeve 75 has a lower lip 81 that extends inward and locates below a stop shoulder 83 on the retaining sleeve 75. A seal 85 seals the lower lip 81 to the exterior of the retaining sleeve 75. A coil spring 87 locates in the interior of the retaining sleeve 75 for urging the retaining sleeve 75 to remain in the locked position. Spring 87 has a lower end that bears against a snap ring 89 rigidly secured to body 45. Spring 87 is compressed and has an upper end that engages a threaded retaining ring 91. Retaining ring 91 threads to the inner diameter of the retaining sleeve 75 at its upper end. Spring 87 pushes upward on the retaining ring 91.

Referring again to FIG. 4, a seal 93 on the inside of retaining ring 91 seals the retaining ring 91 to a body intermediate portion 94. Seals 61, 85 and 93 prevent the entry of foreign material into the interior of the retaining sleeve 75.

Figure 6:
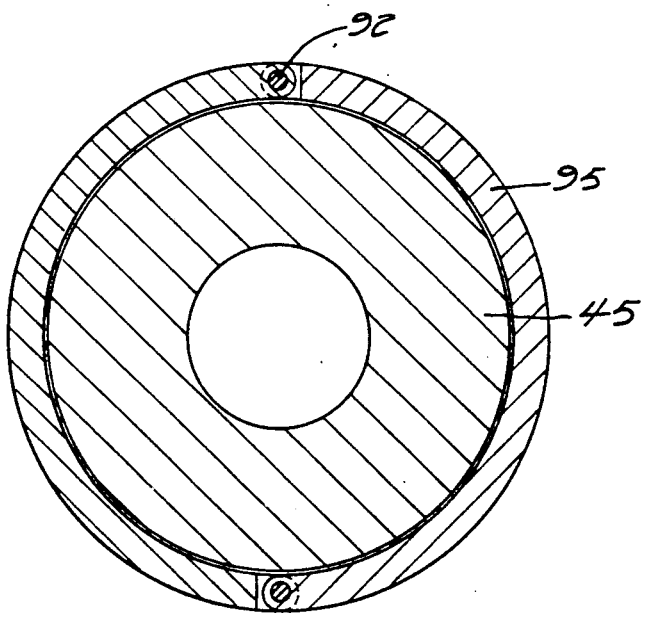
FIG. 6 is transverse sectional view of the torque coupling of FIG. 3, taken along the line VI—VI of FIG. 3.

An extension sleeve 95 extends upward from retaining sleeve 75. As shown in FIG. 6, extension sleeve 95 is in two halves. Pins 92 connect the halves together. Extension sleeve 95 will move in unison with retaining sleeve 75. A flange 97 on the lower end of the extension sleeve 95 connects the extension sleeve 95 to the retaining sleeve 75. Extension sleeve 95 slides upon a body upper portion 99. Holes 101 provide access to the kelly cock 21 (FIG. 1) if necessary. The pins 92 allow the extension sleeve 95 to be quickly removed to apply tongs (not shown) to the upper body portion 99 if needed.

In operation, if it is desired to rotate the drill pipe 25 while pulling it from the hole, then rotary drive means will be employed as the blocks 11 pull the drill string 25 upward. Once a triple stand of three 30 foot sections of drill pipe 25 is above the slips 27, then the slips 27 can be employed to support the drill string in the well. A worker in the derrick will guide the collar 33 of pipe handler 31 (FIG. 2) into engagement with the upper end of the drill pipe 25.

The retaining sleeve 75 (FIG. 3) will be moved downward. This can be handled by the worker physically gripping the retaining sleeve 75 and pushing downward. Alternately, it can be handled by a mechanical actuator (not shown). When the retaining sleeve 75 moves downward, the balls 73 (FIG. 4) will move along the grooves 79 as the inclined surface 77 moves downward. The balls 73 move radially outward as the inclined surface 77 moves downward. This allows the wedge ring 67 to move radially outward relative to the load shoulder 63, 65. Movement of the wedge ring 67 outward causes the distance between the load shoulders 63, 65 to decrease slightly, perhaps only about 0.0001 inch. This removes the compressive force between the torque shoulders 55, 59.

The rotary drive 17 will be rotated in reverse. This spins the body 45 to easily unscrew the pin 51 from the box threads 53. Essentially no torque is required to break out the connection. Consequently, there is no need to provide a back up for the drill pipe 25 to react against break out torque. Once the retaining sleeve 75 is released from its lower position, the spring 87 will push the retaining sleeve 75 back up to its upper locked position shown in FIG. 4.

The workers may then disconnect the lower connection of the triple stand of drill pipe 25 above the slips 27 in a conventional manner using tongs. The driller and the derrick man will then place the triple stand of drill pipe 25 in a storage position in the derrick. The driller pivots the pipe handler 31 (FIG. 2) out of the way and lowers the blocks 11 until the torque coupling 23 locates on the upper end of the drill pipe 25 supported by the slip assembly 27.

To connect the torque coupling 23 to the drill pipe 25 while torque coupling 23 is located near the rig floor, a rig floor worker will push the retaining sleeve 75 back downward. The wedge ring 67 will move radially outward a short distance. The rotary drive 17 will be employed to spin the body 45 to an initial make up of the pin 51 with the box threads 53. The rotational movement will stop once the shoulders 55 and 59 contact each other. High torque is not necessary.

The retaining sleeve 75 will then be moved back to the upper position. When moved to the upper position, retaining sleeve 75 will force the balls 73 back inward, pushing the wedge ring 67 tightly between the load shoulders 63, 65. This applies a compressive force acting through the torque shoulder sleeve 57 to the torque shoulder 55. This will make up the connection without the need for high rotational torque equipment. The driller will then release the slips 27 and pull the drill string 25 again from the well while rotating using a rotational drive means. The operation described above will be repeated.

If it is desired to ream while running into the well, the connection of the torque coupling 23 to the drill pipe 25 must be made up in the derrick. This will be handled while utilizing the pipe handler 31. The derrick worker will place the upper end of a stand of drill pipe 25 in the collar 33. The driller will actuate the hydraulic cylinder 37 (FIG. 2) and pull the stand of drill pipe 25 up into engagement with the torque coupling 23.

The derrick worker will pull the retaining sleeve downward (FIG. 4). The rotary drive 17 will be actuated to spin the torque coupling 23 until the torque shoulders 55, 59 contact each other. No rotational torque is required, and no back up on the drill pipe 25 is needed. The worker then will allow the retaining sleeve 75 to spring back upward. The retaining sleeve 75 will force the wedge ring 67 back inward, preloading the connection to the desired compressive load between shoulders 55, 59. The driller will then move the pipe handler 31 out of the way using the hydraulic cylinder 41 (FIG. 2). The driller then rotates the drill pipe 25 and lowers the drill string into the well during this rotation.

The elevators 43 may be used for conventional tripping into and out of the well while not reaming. During this operation, the swivel 15, rotary drive 17 and torque coupling 23 will be set aside. During normal drilling, a triple stand will normally be previously made up and connected into the drill string 25 in the manner previously described.

If a pressure kick occurs, the kelly cock 21 can be manually closed. The pup joint 19 and swivel 15 can be disconnected from the kelly cock 21 (FIG. 1). To do so, the workers will remove one of the pins 92 (FIG. 6). This enables the extension sleeve 95 to be removed. Conventional tongs can then be placed on the upper portion 99 of body 45 and on the pup joint 19 to unscrew the pup joint 19 from the kelly cock 21.

The invention has significant advantages. The torque coupling enables a joint to be broken out and made up with essentially no torque required. The torque coupling allows one to utilize a drilling system without the need for power tongs in the derrick. It allows the make up and break out of connections in the derrick without the need for back up tongs at the rig floor.

While the invention has been shown in only one of its forms, it should be apparent to those skilled in the art that it is not so limited but susceptible to various changes without departing from the scope of the invention.

I claim:

1. A torque coupling for connection between upper and lower tubular members, the lower tubular member having an internally threaded box with an upward facing torque shoulder on its upper end, the torque coupling comprising in combination:

a body having a vertical axis and a lower end with an externally threaded pin for connection to the box of the lower tubular member;

connection means on an upper end of the body for connecting the body to the upper tubular member;

a torque shoulder sleeve mounted to the exterior of the body and having a downward facing torque shoulder for engaging the torque shoulder of the box;

the torque shoulder sleeve having an upper end with an upward facing load shoulder;

the body having a downward facing load shoulder spaced above the load shoulder of the torque shoulder sleeve, at least one of the load shoulder being conical, providing a greater vertical distance between the load shoulders at outer peripheries of the load shoulders than at inner peripheries of the load shoulders;

a wedge member carried between the downward facing load shoulder of the body and the upward facing load shoulder of the torque shoulder sleeve, the wedge member having lower and upper surfaces that mate with the load shoulders, the wedge member being movable from a radial inner position transmitting a compressive force from the downward facing load shoulder through the wedge member and torque shoulder sleeve to the upward facing torque shoulder of the box, to an outer position relative to the load shoulders, reducing said compressive force;

bias means for urging the wedge member to the outer position; and retaining means for selectively preventing the wedge member from moving outward to the outer position, and for selectively allowing the wedge member to move to the outer position to allow the body to be easily broken out from the lower tubular member.

2. The torque coupling according to claim 1 wherein both of the downward facing load shoulder of the body and upward facing load shoulder of the torque shoulder sleeve are conical.

3. The torque coupling according to claim 1 wherein the retaining means comprises:

a retaining sleeve mounted to the exterior of the body for axial sliding movement between a locked position and a released position; and engaging means in the retaining sleeve for pressing radially inward against the wedge member when the retaining sleeve is in the locked position, and for allowing the wedge member to move to the outer position when the retaining sleeve moves to the released position.

4. The torque coupling according to claim 1 wherein the retaining means comprises:

a retaining sleeve mounted to the exterior of the body for vertical sliding movement between a locked position and a released position;

engaging means in the retaining sleeve for pressing radially inward against the wedge member when the retaining sleeve is in the locked position, and for allowing the wedge member to move to the outer position when the retaining sleeve moves to the released position; and wherein moving the retaining sleeve from the released position to the locked position when the body is threaded to the lower tubular member moves the wedge member back to the inner position to apply a preload force to the upward facing torque shoulder.

5. The torque coupling according to claim 1 wherein the retaining means comprises:

a retaining sleeve mounted to the exterior of the body for vertical sliding movement between a locked position and a released position;

an inclined surface located in the interior of the retaining sleeve, having a large diameter end and a smaller diameter end; and a plurality of balls in the retaining sleeve between the inclined surface and the wedge member, for pressing radially inward against the wedge member when the retaining sleeve is in the locked position, and for allowing the wedge member to move to the outer position when the retaining sleeve moves to the released position.

6. A torque coupling for connection between upper and lower tubular members, the lower tubular member having an internally threaded box with an upward facing torque shoulder on its upper end, the torque coupling comprising in combination:

a body having a vertical axis and a lower end with an externally threaded pin for connection to the box of the lower tubular member;

connection means on an upper end of the body for connecting the body to the upper tubular member;

a torque shoulder sleeve mounted to the exterior of the body, and having a downward facing torque shoulder for engaging the torque shoulder of the box;

the torque shoulder sleeve having an upper end with an upward facing load shoulder;

the body having a downward facing load shoulder spaced above the load shoulder of the torque shoulder sleeve, at least one of the load shoulders being conical, providing a greater vertical distance between the load shoulder at outer peripheries of the load shoulders than at inner peripheries of the load shoulders;

a wedge member carried between the downward facing load shoulder of the body and the upward facing load shoulder of the torque shoulder sleeve, the wedge member having lower and upper surfaces that mate with the load shoulders, the wedge member being movable from a radial inner position transmitting a compressive force from the downward facing load shoulder through the wedge member and torque shoulder sleeve to the upward facing torque shoulder of the box, to an outer position relative to the load shoulders, reducing said compressive force;

the wedge member being a split ring which is radially compressed when the wedge member is in the inner position; and retaining means for selectively preventing the wedge member from moving outward to the outer position, and for selectively allowing the wedge member to move to the outer position to allow the body to be easily broken out from the lower tubular member.

7. The torque coupling according to claim 6 wherein both of the downward facing load shoulder of the body and upward facing load shoulder of the torque shoulder sleeve are conical.

8. The torque coupling according to claim 6 wherein the retaining means comprises:

a retaining sleeve mounted to the exterior of the body for vertical sliding movement between a locked position and a released position; and engaging means in the retaining sleeve for pressing radially inward against the wedge member when the retaining sleeve is in the locked position, and for allowing the wedge member to move to the outer position when the retaining sleeve moves to the released position.

9. The torque coupling according to claim 6 wherein the retaining means comprises:

a retaining sleeve mounted to the exterior of the body for vertical sliding movement between a locked position and a released position;

an inclined surface located in the interior of the retaining sleeve, having a larger diameter end and a smaller diameter end; and a plurality of balls in the retaining sleeve between the inclined surface and the wedge member, for pressing radially inward against the wedge member when the retaining sleeve is in the locked position, and for allowing the wedge member to move to the outer position when the retaining sleeve moves to the released position, the inclined surface moving relative to the balls when the retaining sleeve moves between the locked and released positions.

10. The torque coupling according to claim 6 wherein the retaining means comprises:

a retaining sleeve mounted to the exterior of the body for vertical sliding movement between a locked position and a released position;

spring means for urging the retaining sleeve to the locked position;

engaging means in the retaining sleeve for pressing radially inward against the wedge member when the retaining sleeve is in the locked position, and for allowing the wedge member to move to the outer position when the retaining sleeve moves to the released position; and wherein moving the retaining sleeve from the released position to the locked position when the body is threaded to the lower tubular member moves the wedge member back to the inner position to apply a preload force to the upward facing torque shoulder.

11. A torque coupling for connection between upper and lower tubular members, the lower tubular member having an internally threaded box with an upward facing torque shoulder on its upper end, the torque coupling comprising in combination:

a body having a vertical axis and a lower end with an externally threaded pin for connection to the box of the lower tubular member;

connection means on an upper end of the body for connecting the body to the upper tubular member;

a torque shoulder sleeve slideably mounted to the exterior of the body and having a downward facing torque shoulder for engaging the torque shoulder of the box;

the torque shoulder sleeve having an upper end with an upward facing load shoulder;

the body having a downward facing load shoulder spaced above the load shoulder of the torque shoulder sleeve, each of the load shoulders being inclined relative to the axis of the body, providing a greater vertical distance between the load shoulders at outer peripheries of the load shoulders than at inner peripheries of the load shoulders;

a wedge member carried between the downward facing load shoulder of the body and the upward facing load shoulder of the torque shoulder sleeve, the wedge member having lower and upper surfaces that mate with the load shoulders, the wedge member being movable from a radial inner position transmitting a compressive force from the downward facing load shoulder through the wedge member and torque shoulder sleeve to the upward facing torque shoulder of the box, to an outer position relative to the load shoulders, reducing said compressive force;

the wedge member being a split ring which is radially compressed when the wedge member is in the inner position;

a retaining sleeve mounted to the exterior of the body for vertical sliding movement between an upper locked position and a lower released position;

spring means mounted between the retaining sleeve and the body for urging the retaining sleeve upward;

an inclined surface located in the interior of the retaining sleeve, having a large diameter upper end and a smaller diameter lower end;

a plurality of vertically extending grooves located on the inclined surface;

a plurality of concave recesses located on an outer side of the wedge member opposite the grooves;

a plurality of balls in the retaining sleeve carried in the grooves and recesses between the inclined surface and the wedge member, for pressing radially inward against the wedge member when the retaining sleeve is in the locked position, and for allowing the wedge member to move to the outer position when the retaining sleeve moves to the released position, the grooves moving downward relative to the balls when the retaining sleeve moves downward.

12. The torque coupling according to claim 11, wherein:

moving the retaining sleeve upward from the released position to the locked position when the body is initially threaded to the lower tubular member moves the wedge member back to the inner position to apply a preload force to the upward facing torque shoulder, allowing the body to be made up initially to the lower tubular member at less than desired make up torque.

13. A method for making up and braking out a connection between upper and lower tubular members, the lower tubular member having an internally threaded box with an upward facing torque shoulder on its upper end, comprising in combination:

providing a torque coupling comprising:

a body having a vertical axis and a lower end with an externally threaded pin:

a torque shoulder sleeve mounted to the exterior of the body and having a downward facing torque shoulder for engaging the torque shoulder of the box;

the torque shoulder sleeve having an upper end with an upward facing load shoulder;

the body having a downward facing load shoulder spaced above the load shoulder of the torque shoulder sleeve, at least one of the load shoulders being conical, providing a greater vertical distance between the load shoulders at outer peripheries of the load shoulders than at inner peripheries of the load shoulders;

a wedge member carried between the downward facing load shoulder of the body and the upward facing load shoulder of the torque shoulder sleeve, the wedge member having lower and upper surfaces that mate with the load shoulders, the wedge member being movable from a radial inner position transmitting a compressive force from the downward facing load shoulder through the wedge member and torque shoulder sleeve to the upward facing torque shoulder of the box, to an outer position relative to the load shoulders, reducing said compressive force;

connecting the upper end of the body to the upper tubular member;

connecting the pin of the body to the box of the lower tubular member by rotating the body and lower tubular member relative to each other while the wedge member is in the outer position until the torque shoulders contact each other; then moving the wedge member to the inner position, applying a compressive load through the torque shoulder sleeve to the upward facing load shoulder of the box to increase the compressive load between the torque shoulders to the desired make up load; then, to break out the connection, moving the wedge member back to the outer position, releasing the compressive load in the torque shoulder sleeve and between the torque shoulders; then rotating the body and the lower tubular member relative to each other to unscrew the body and the lower tubular member from each other.

14. A torque coupling for connection between upper and lower tubular members, the lower tubular member having an internally threaded box with an upward facing torque shoulder on its upper end, the torque coupling comprising in combination:

a body having a vertical axis and a lower end with an externally threaded pin for connection to the box of the lower tubular member;

connection means on an upper end of the body for connecting the body to the upper tubular member;

p1 a torque shoulder sleeve mounted to the exterior of the body and having a downward facing torque shoulder for engaging the torque shoulder of the box;

the torque shoulder sleeve having an upper end with an upward facing conical load shoulder;

the body having a downward facing conical load shoulder spaced above the load shoulder of the torque shoulder sleeve, at least one of the load shoulders being conical, providing a greater vertical distance between the load shoulders at outer peripheries of the load shoulders than at inner peripheries of the load shoulders;

a wedge member carried between the downward facing conical load shoulder of the body and the upwardly facing conical load shoulder of the torque shoulder sleeve, the wedge member having lower and upper surfaces that mate with the load shoulders, the wedge member being movable from a radial inner position transmitting a compressive force from the upper load shoulder through the wedge member and torque shoulder sleeve to the upward facing torque shoulder of the box, to an outer position relative to the load shoulders, reducing said compressive force;

bias means for urging the wedge member to the outer position; and retaining means for selectively preventing the wedge member from moving outward to the outer position, and for selectively allowing the wedge member to move to the outer position to allow the body to be easily broken out from the lower tubular member, wherein said retaining means includes:

a retaining sleeve mounted to the exterior of the body for axial sliding movement between a locked position and a released position; and engaging means in the retaining sleeve for pressing radially inward against the wedge member when the retaining sleeve is in the locked position, and for allowing the wedge member to move to the outer position when the retaining sleeve moves to the released position.

15. The torque coupling according to claim 14, wherein:

moving the retaining sleeve from the released position to the locked position when the body is threaded to the lower tubular member moves the wedge member back to the inner position to apply a preload force to the upward facing torque shoulder.

16. The torque coupling according to claim 14, wherein the retaining means further comprises:

an inclined surface located in the interior of the retaining sleeve, having a larger diameter end and a smaller diameter end; and a plurality of balls in the retaining sleeve between the inclined surface and the wedge member, for pressing radially inward against the wedge member when the retaining sleeve is in the locked position, and for allowing the wedge member to move to the outer position when the retaining sleeve moves to the released position.

17. A torque coupling for connection between upper and lower tubular members, the lower tubular member having an internally threaded box with an upward facing torque shoulder on its upper end, the torque coupling comprising in combination:

a body having a vertical axis and a lower end with an externally threaded pin for connection to the box of the lower tubular member;

connection means on an upper end of the body for connecting the body to the upper tubular member;

a torque shoulder sleeve mounted to the exterior of the body, and having a downward facing torque shoulder for engaging the torque shoulder of the box;

a torque shoulder sleeve having an upper end with an upward facing conical load shoulder;

the body having a downward facing conical load shoulder spaced above the load shoulder of the torque shoulder sleeve, at least one of the load shoulders being conical, providing a greater vertical distance between the load shoulders at outer peripheries of the load shoulders than at inner peripheries of the load shoulders;

a wedge member carried between the downward facing conical load shoulder of the body and the upward facing conical load shoulder of the torque shoulder sleeve, the wedge member having lower and upper surfaces that mate with the load shoulders, the wedge member being movable from a radial inner position transmitting a compressive force from the upper load shoulder through the wedge member and torque shoulder sleeve to the upward facing torque shoulder of the box, to an outer position relative to the load shoulders, reducing said compressive force;

the wedge member being a split ring which is radially compressed when the wedge member is in the inner position;

retaining means for selectively preventing the wedge member from moving outward to the outer position, and for selectively allowing the wedge member to move to the outer position to allow the body to be easily broken out from the lower tubular member, wherein said retaining means includes:

a retaining sleeve mounted to the exterior of the body for vertical sliding movement between a locked position and a released position; and engaging means in the retaining sleeve for pressing radially inward against the wedge member when the retaining sleeve is in the locked position, and for allowing the wedge member to move to the outer position when the retaining sleeve moves to the released position.

18. The torque coupling according to claim 17, wherein the retaining means further comprises:

an inclined surface located in the interior of the retaining sleeve, having a larger diameter end and a smaller diameter end; and a plurality of balls in the retaining sleeve between the inclined surface and the wedge member, for pressing radially inward against the wedge member when the retaining sleeve is in the locked position, and for allowing the wedge member to move to the outer position when the retaining sleeve moves to the released position, the inclined surface moving relative to the balls when the retaining sleeve moves between the locked and released positions.

19. The torque coupling according to claim 17, wherein the retaining means further comprises:

spring means for urging the retaining sleeve to the locked position; wherein moving the retaining sleeve from the released position to the locked position when the body is threaded to the lower tubular member moves the wedge member back to the inner position to apply a preload force to the upward facing torque shoulder.

20. A torque coupling for connection between upper and lower tubular members, the lower tubular member having an internally threaded box with an upward facing torque shoulder on its upper end, the torque coupling comprising in combination:

a body having a vertical axis and a lower end with an externally threaded pin for connection to the box of the lower tubular member;

connection means on an upper end of the body for connecting the body to the upper tubular member;

a torque shoulder sleeve slideably mounted to the exterior of the body and having a downward facing torque shoulder for engaging the torque shoulder of the box;

the torque shoulder sleeve having an upper end with an upward facing load shoulder;

the body having a downward facing load shoulder spaced above the load shoulder of the torque shoulder sleeve, each of the load shoulders being inclined relative to the axis of the body, providing a greater vertical distance between the load shoulders at inner peripheries of the load shoulders than at outer peripheries of the load shoulders;

a wedge member carried between the load shoulders, the wedge member having lower and upper surfaces that mate with the load shoulders, the wedge member being movable from a radial inner position transmitting a compressive force from the upper load shoulder through the wedge member and torque shoulder sleeve to the upward facing torque shoulder of the box, to an outer position relative to the load shoulders, reducing said compressive force;

the wedge member being a split ring which is radially compressed when the wedge member is in the inner position;

a retaining sleeve mounted to the exterior of the body for vertical sliding movement between an upper locked position and a lower released position;

spring means mounted between the retaining sleeve and the body for urging the retaining sleeve upward;

an inclined surface located in the interior of the retaining sleeve, having a larger diameter upper end and a smaller diameter lower end;

a plurality of vertically extending grooves located on the inclined surface;

a plurality of concave recesses located on an outer side of the wedge member opposite the grooves;

a plurality of balls in the retaining sleeve carried in the grooves and recesses between the inclined surface and the wedge member, for pressing radially inward against the wedge member when the retaining sleeve is in the locked position, and for allowing the wedge member to move to the outer position when the retaining sleeve moves to the released position, the grooves moving downward relative to the balls when the retaining sleeve moves downward, wherein:

moving the retaining sleeve upward from the released position to the locked position when the body is initially threaded to the lower tubular member moves the wedge member back to the inner position to apply a preload force to the upward facing torque shoulder, allowing the body to be made up initially to the lower tubular member at less than desired make up torque.

* * * * *